US007784232B2

(12) United States Patent
Nygren et al.

(10) Patent No.: US 7,784,232 B2
(45) Date of Patent: Aug. 31, 2010

(54) BALLISTIC SHELTER OF MODULAR PANELS COUPLED BY PIVOTALLY MOUNTED SPRING-CLOSED CLAWS ENGAGED IN SLOTS ADJACENT CYLINDRICAL EDGE PORTIONS

(75) Inventors: Kari Nygren, Nokia (FI); Pertti Siirilä, Hämeenlinna (FI); Raimo Tihula, Kangasala (FI)

(73) Assignee: FY-Composites Oy, Nokia (FI)

( * ) Notice: Subject to any disclaimer, the term of this patent is extended or adjusted under 35 U.S.C. 154(b) by 1001 days.

(21) Appl. No.: 10/850,265

(22) Filed: May 20, 2004

(65) Prior Publication Data

US 2005/0257479 A1 Nov. 24, 2005

(51) Int. Cl.
*E04B 1/38* (2006.01)
*E04B 2/00* (2006.01)

(52) U.S. Cl. ..... 52/285.3; 52/584.1; 24/457; 24/500

(58) Field of Classification Search ..... 52/285.3, 52/584.1; 220/4.33, 4.28; 403/119, 399, 403/71, 322.1, 66, 398, 196, 235, 68, 325, 403/327, 330, 322.4; 24/334, 457, 458, 497, 24/499, 500

See application file for complete search history.

(56) References Cited

U.S. PATENT DOCUMENTS 1,362,512 A * 12/1920 Schermuly ..... 24/599.9
2,057,942 A * 10/1936 Fay ..... 446/112
2,924,858 A * 2/1960 Couse et al. ..... 52/586.2
3,317,972 A * 5/1967 Harley ..... 24/599.4
3,604,685 A * 9/1971 Pokryfki ..... 256/25
3,660,952 A * 5/1972 Wilson ..... 52/81.4
3,661,410 A * 5/1972 Larson et al. ..... 52/127.9
3,858,372 A * 1/1975 Wilson ..... 52/81.4
3,871,143 A * 3/1975 Quick ..... 52/309.1
3,974,600 A 8/1976 Pearce
4,055,019 A * 10/1977 Harvey ..... 446/115
4,067,164 A * 1/1978 McMillan ..... 52/309.12
4,212,130 A * 7/1980 Walker ..... 446/111
4,253,268 A * 3/1981 Mayr ..... 446/104
4,544,324 A * 10/1985 Hornung ..... 414/785
4,566,237 A * 1/1986 Turner ..... 52/269
4,567,100 A * 1/1986 Pickett et al. ..... 428/339
4,613,535 A * 9/1986 Harpell et al. ..... 428/113
4,640,061 A * 2/1987 Trumley ..... 52/71
4,685,892 A * 8/1987 Gould et al. ..... 446/109
4,702,047 A * 10/1987 Stokes ..... 52/156
4,748,790 A * 6/1988 Frangolacci ..... 52/794.1

(Continued)

FOREIGN PATENT DOCUMENTS

DE 4434350 3/1996

(Continued)

*Primary Examiner*—Gay Ann Spahn
(74) *Attorney, Agent, or Firm*—Baker & Daniels LLP

(57) ABSTRACT

A lightweight ballistic shelter comprising mutually connectable modular panels of two sizes only (8, 7, 6). Each panel (8, 7, 6) of the shelter structure is connectable to any other panel of the shelter system thus allowing protective structures of different sizes and shapes to be assembled therefrom. The shelter is assembled from planar panels of which at least one (6) has the shape of an equilateral triangle and at least another one (7) has a square shape. The shelter system also includes coupler means (4, 5) for connecting the modular panels (6, 7, 8) with each other.

8 Claims, 14 Drawing Sheets

U.S. PATENT DOCUMENTS

| | | | | | |
|---|---|---|---|---|---|
| 4,784,172 | A | | 11/1988 | Yacoboni | |
| 4,937,125 | A | * | 6/1990 | Sanmartin et al. | 428/116 |
| 4,966,097 | A | * | 10/1990 | Rosenberger | 119/482 |
| 5,006,293 | A | * | 4/1991 | Hartman et al. | 264/137 |
| 5,100,358 | A | * | 3/1992 | Volgger | 446/104 |
| 5,411,073 | A | | 5/1995 | Andrews | |
| 5,452,555 | A | * | 9/1995 | Lee | 52/584.1 |
| 5,472,365 | A | * | 12/1995 | Engel | 446/104 |
| 5,560,151 | A | * | 10/1996 | Roberts | 52/81.1 |
| 5,611,187 | A | * | 3/1997 | Jones | 52/646 |
| 6,085,477 | A | * | 7/2000 | Hiese et al. | 52/270 |
| 6,532,701 | B2 | * | 3/2003 | Williams | 52/71 |
| 7,389,618 | B1 | * | 6/2008 | Herkstroeter et al. | 52/285.3 |
| 7,438,623 | B2 | * | 10/2008 | Lin | 446/108 |
| 2002/0065017 | A1 | * | 5/2002 | Huang | 446/107 |
| 2004/0168391 | A1 | * | 9/2004 | Yamaura | 52/584.1 |
| 2004/0250494 | A1 | * | 12/2004 | Osiatinskiy et al. | 52/582.1 |

FOREIGN PATENT DOCUMENTS

| | | |
|---|---|---|
| FI | 91795 | 2/1990 |
| FI | U1518 | 6/1994 |
| GB | 522619 | 1/1940 |
| GB | 1319567 | 6/1973 |
| GB | 2345069 | 6/2000 |

* cited by examiner

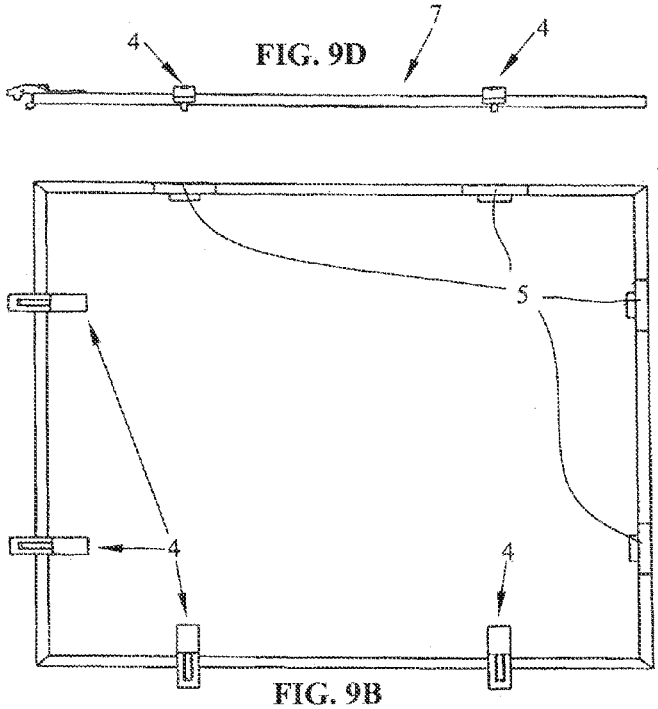
FIG. 9D
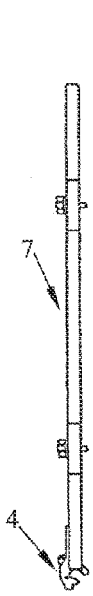
FIG. 9A
FIG. 9B
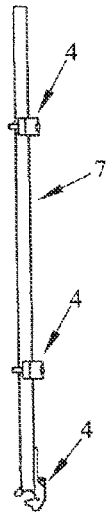
FIG.9C
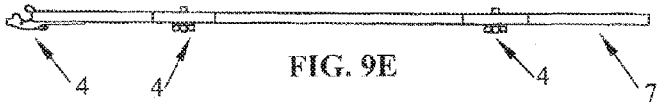
FIG. 9E

BALLISTIC SHELTER OF MODULAR PANELS COUPLED BY PIVOTALLY MOUNTED SPRING-CLOSED CLAWS ENGAGED IN SLOTS ADJACENT CYLINDRICAL EDGE PORTIONS

BACKGROUND OF THE INVENTION

1. Field of the Invention

The present invention relates to a protective shelter against fragment effect, fire from light/small arms and like external effect.

2. Description of the Related Art

In different conflict situations, it is imperative to protect own troops and equipment from the adversary's fire and other hostile activity in order to maintain the operational functionality of own troops. Such conflict situations include wars, peacekeeping operations, wide riots and similar occurrences that presumably may involve the use of light/small arms, bombs, other explosives or, simply, throwable objects alone. Particularly in war situations, modern warfare doctrines strongly emphasize fast deployment and speed of troops, whereby arduous long-term field fortifications are impossible. On the other hand, today's world appears to meet at an increasing rate such situations that require temporary or semi-temporary shelter constructions. These needs are especially typical in peacekeeping operations and, sometimes, also in conjunction with international summits involving the risk of protest demonstrations turning violent.

Conventionally, troops are protected by the shelter offered by armored vehicles, rapid digging or other preparation of a shelter from locally available material. If efficient digging is not possible, shelter erection becomes both time-consuming and frequently necessitates haulage of construction materials to the erection site. During peace, digging or erection of heavy shelter constructions in an urban environment is generally entirely out of question. In Finnish utility model reg. no. U 1518 is disclosed a shelter assembly system comprised of polygonal or sector-shaped panels made from a metal or non-metal material and adapted connectable to each other. Along the edges of the panels, suitably spaced apart from each other, are fitted coupler bushings of noncircular cross section. When two elements are placed abutting edge-to-edge, the coupler bushings of the panels form a string of interleaved bushings. Thus, the panels can be connected to each other by means of a locking bar threaded through the string of coupler bushings. The panel may have a planar or curved surface and also the panel edges may be planar or profiled.

The above-described construction is hampered by its relatively heavy structure and the limited number of angles possible in the connection of the panels to each other. The cross-sectional shape of the coupler bushings and the locking bar constrain the allowable locking angles between the panels. Additionally, the spacing pitch of the coupler bushings on one edge of a given panel are dictated by the spacing pitch along the mating edge of the adjoining panel thus necessitating the use of a given set of panels in the connection of the panels to each other. As a result, shaped panels for instance cannot be used but in a single given construction or, alternatively, in another shelter but only with an exactly identical construction. Hence, the modifiability of a fortification erected according to this construction is limited and, hence, the panel system is optimally usable only for rapidly erecting a relatively long-term fortification at a terrestrial point taken over. Such locations are, e.g., guard and observation points and like. According to the teachings of the example of the invention, metallic materials are employed for strengthening the panel edges and as connecting members, whereby the weight of the panels becomes high. Obviously, the panel weights are also increased by their size.

SUMMARY OF THE INVENTION

It is an object of the present invention to provide a lightweight ballistic shelter system comprising mutually connectable panels of two sizes only. Each panel of the novel shelter structure is connectable to any other panel of the shelter system thus allowing protective structures of different sizes and shapes to be assembled therefrom.

The goal of the invention is achieved by virtue of having the shelter system comprised of planar panel elements of which at least one has the shape of an equilateral triangle and at least another one has a rectangular shape.

According to a preferred embodiment of the invention is characterized in that at least one edge of the shelter system panels includes at least one open coupling slot having a smoothly rounded surface provided on at least the inner slot edge facing the inner area of the panel.

More specifically, the ballistic shelter according to the invention is characterized in that the panel elements are planar with straight edges, and said shelter system comprises at least one triangular panel and at least one rectangular panel.

The invention offers significant benefits.

By virtue of the invention, a lightweight modular shelter is provided with ease of erection. The construction and shape of the shelter system components facilitate the assembly of shelters in varying shapes, whereby the maximal size of the shelter is limited only by the number of available panel elements. Inasmuch as the shelter system comprises panel elements of two different sizes only and all the panel elements are connectable to each other, the erection of a shelter becomes simple, whereby different types of shelters are possible without the need for multiple parts that must be shipped connected together. The erection of a shelter can be carried out extremely quickly and the coupler means may be implemented as quick-lock couplers whose locking levers on a given edge of the panel are connected together by a rope thus permitting the locking levers to be released simultaneously by a single pull. As the coupler means are integral members of the shelter panels, they cannot become lost during the haulage, erection or dismantling of the shelter. The coupler means are further adapted to the edges of the panel elements in such a fashion that any panel element can be connected to any other panel element. The level of protection provided by the panel elements can be designed compatible with the protection needs depending on whether the shelter shall offer protection against fragments, stop fire from small arms or other offense. The shelter panels are also highly durable under the stresses imposed thereon during haulage and handling, as well as very resistant to weather exposure due to their entirely sealed structure with fully sealed edges. Planar panels of triangular and square shape connected to each other allows a maximally simple construction to provide full protection by a shelter of desired kind, wherein all panel elements of the shelter are always compatible with each other thus disposing with the need for any special complementary members.

BRIEF DESCRIPTION OF THE DRAWINGS

In the following, the invention is described in more detail by making reference to the appended drawings in which

FIG. 9A shows a square panel element in a side view;

FIG. 9B shows a triangular panel element in a top view;

FIG. 9C shows a triangular panel element in a side view;

FIG. 9D shows a triangular panel element in a side view;

FIG. 9E shows a triangular panel element in a side view;

DETAILED DESCRIPTION OF INVENTION

Figure 1:
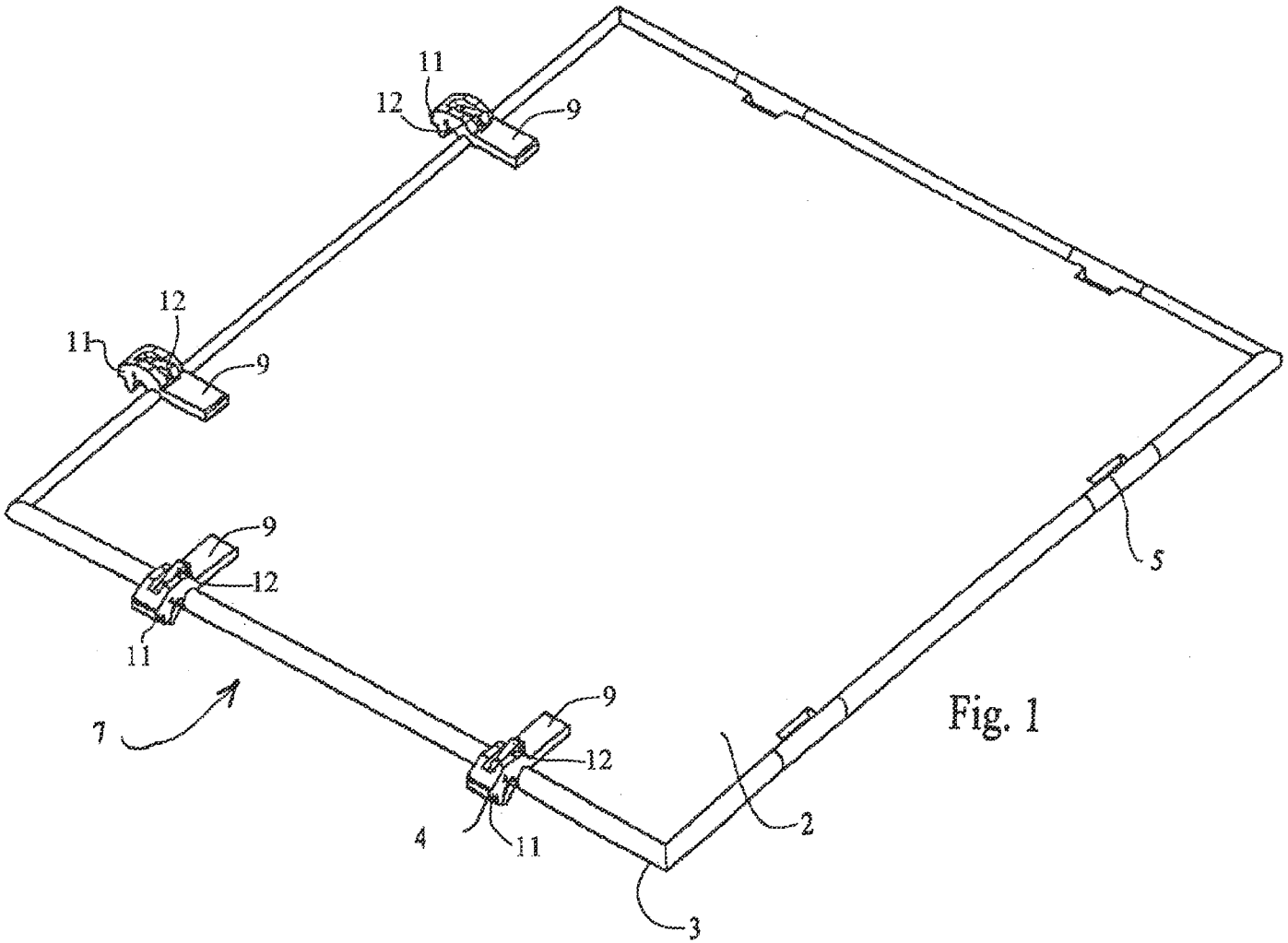
FIG. 1 shows an embodiment of a modular panel element usable in the erection of a shelter.

Referring to FIG. 1, a square-shaped modular shelter panel element is shown therein. The shelter panel element 1 comprises a planar part 2, edges 3, pawl couplers 4 and open slots 5 shaped to accommodate the coupler pawls. The planar part 2 is manufactured from a composite material offering sufficient level of protection. The thickness, materials and production method of the panel are selected depending on whether the shelter is required to protectively encounter only a relatively mild fragment effect, give better protection against direct fire from small arms or resist the fire and fragments of even heavier arms. In practice, the shelter provides good protection against fragments and small arms fire, while stronger structures or even armor must be used against the fire of heavier arms. The basic material of the planar part 2 comprises reinforcing fiber bonded in a matrix of a thermoset or thermoplastic polymeric material. The most generally employed fiber in this kind of protective structure is aramide fiber, but also glass or polyethylene fiber is applicable. The matrix material may be a phenolic or epoxy resin. Inasmuch as the material of the planar part is irrelevant to the spirit of the present invention, any material capable of offering a sufficiently lightweight planar structure of sufficiently good protective effect may be contemplated suitable for use in the manufacture of the planar part.

The edges 3 of the planar part 2 are rounded smooth and sealed with a durable, elastic and weather-resistant material such as an urethane-based sealant or, in the case that matrix material has suitable properties, using the matrix material also for surfacing the edges so as to make them highly resistant to impacts and other mechanical stresses as well as capable of preventing penetration of water into the matrix material. With the smoothly rounded profile of modular panel edges 3, the system becomes extremely flexible inasmuch as any planar panel element can thus be readily connected to another planar panel element at any angle. Additionally, the cross sections of open slots 5 and pawl recesses of couplers 4 of the panel connection system are shaped in a convex/concave rounded fashion, whereby the clamping hold of the coupler is similar to the grip of a plumber's wrench about a round tube. In the illustrated embodiment, the open slots 5 comprise openings made in the planar part 2 such that the panel edge at the open slot 5 forms a bridge of a circular cross section. Hence, the coupler can be locked at any angle of the panel and, moreover, panels already connected to each other may be rotated even after connection if it is desired to alter the mutual position of the panels.

Figure 2:
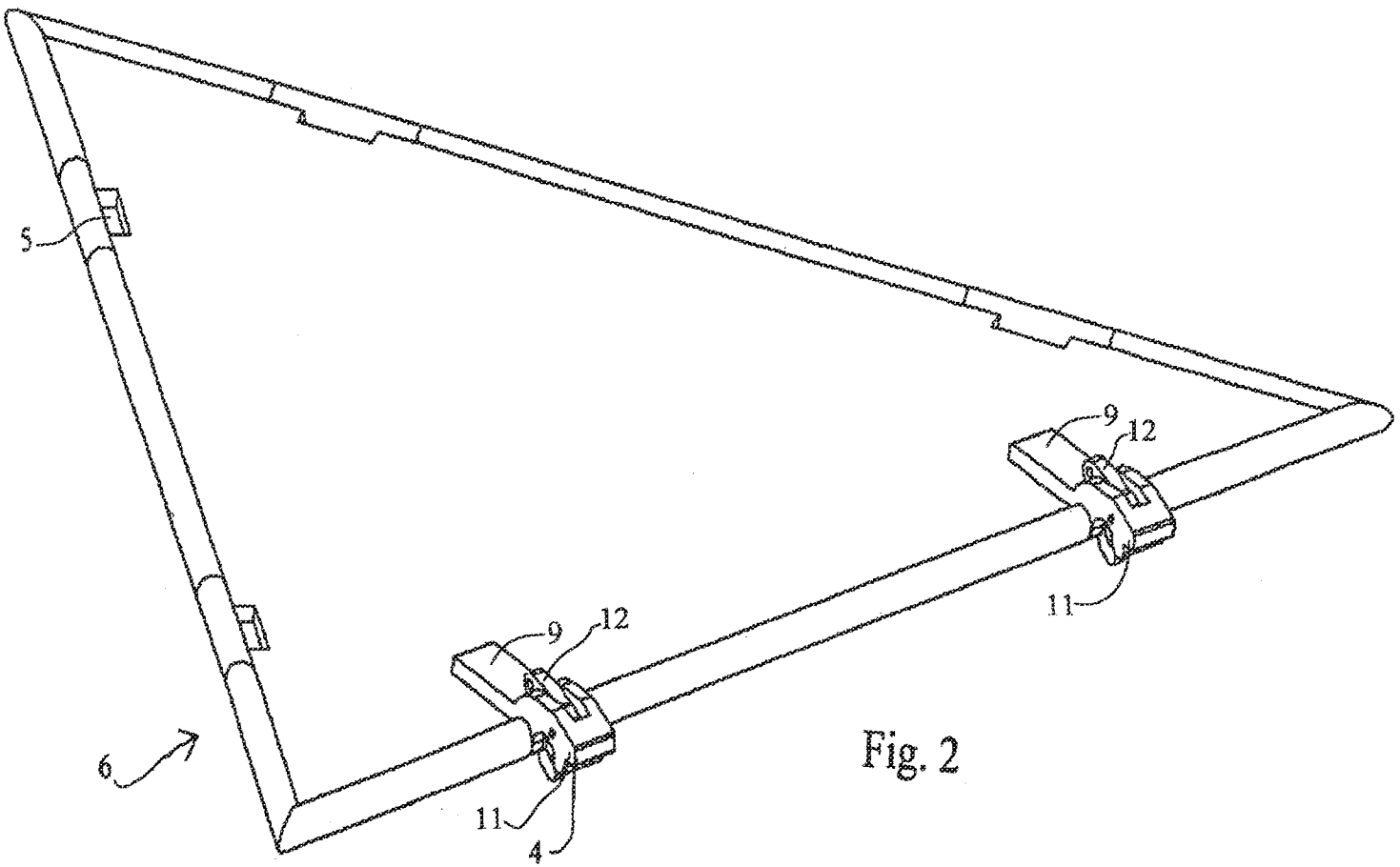
FIG. 2 shows another embodiment of a modular panel element usable in the erection of a shelter.

The couplers 4 are placed on two cornering edges of a panel element, while the open slots 5 of the coupling system are made along the opposite edges of the panel, at identical positions relative to the couplers 4. Resultingly, the modular panels I will be connectable to each other in any kind of protective shelter assembly. In FIG. 2 is shown a modular panel element 6 shaped as a triangle. The triangular modular panel 6 has a similar structure as the square panel 1 described above. The only difference in regard to the square panel can be seen in the panel shape and in that the couplers 4 are mounted on one edge of the triangular panel only, while the open slots 5 are located along both of the other edges. By virtue of this coupler means arrangement, the triangular panel becomes connectable to any adjacent modular panel, whether triangular or square.

Figure 3:
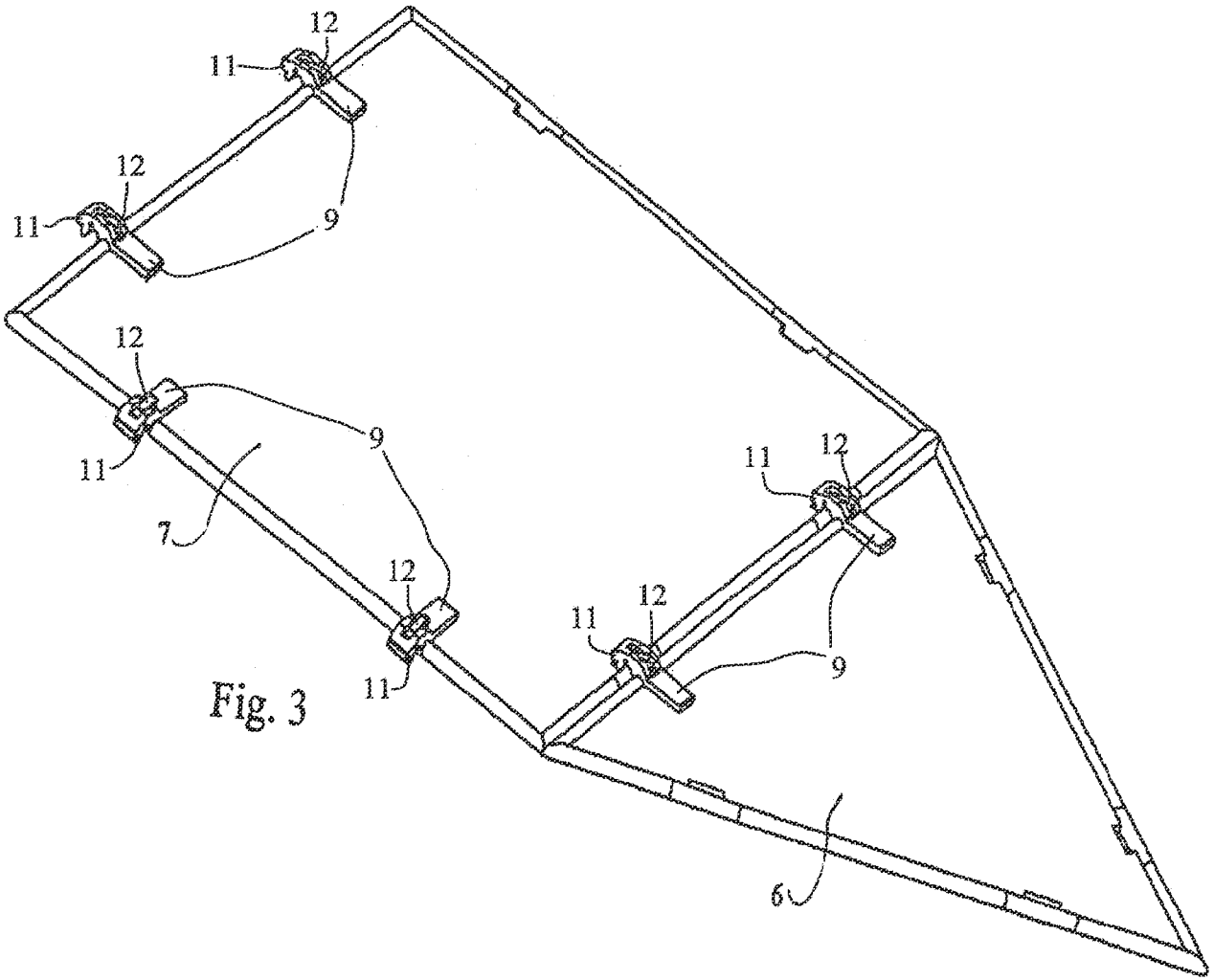
FIG. 3 shows the modular panel elements of FIGS. 1 and 2 connected together.
Figure 4:
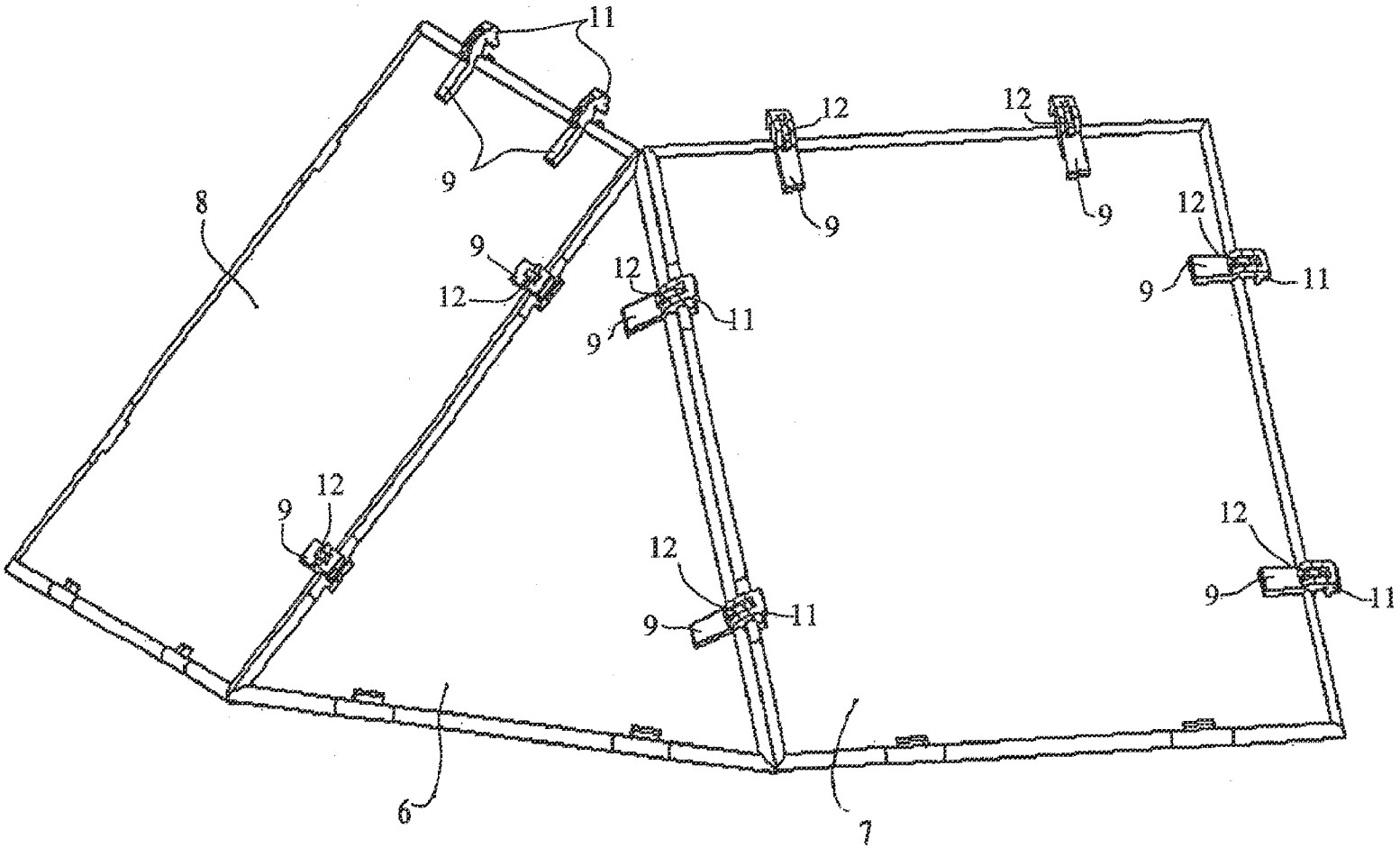
FIG. 4 shows three modular panel elements connected together.

In FIG. 3, a triangular modular panel 6 is shown connected to a rectangular modular panel 7. In this embodiment, the short edge of the rectangular panel 7 has the same length as the short edge of the triangular panel. The triangular panel is not equilateral and the length of its long edges is equal to the length of the long edges of the rectangular panel. While this selection of the dimensions of the modular panels puts some constraints on their connectability, it may serve particularly well in certain applications. The shelter system shown in FIG. 4 has further a narrow rectangular panel 8 connected to one edge of the triangular panel.

Figure 5:
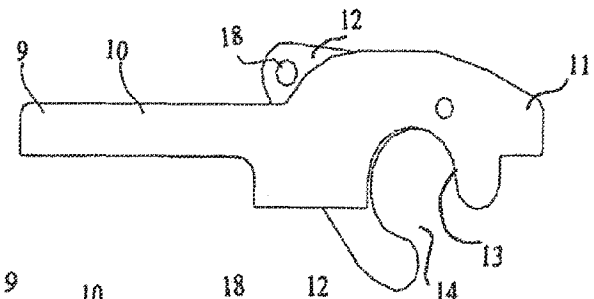
FIG. 5 shows an embodiment of a coupler suited for use in the connection of modular panel elements.
Figure 6:
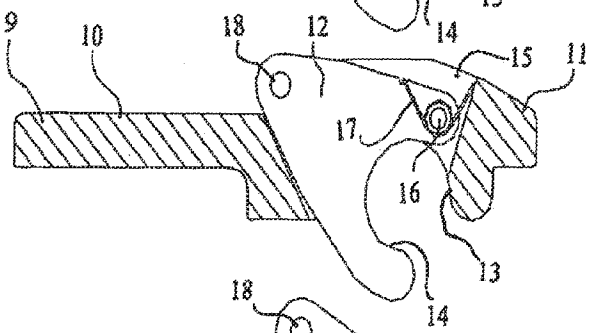
FIG. 6 shows a cross sectional view of an embodiment of a coupler suited for use in the connection of modular panel elements.
Figure 7:
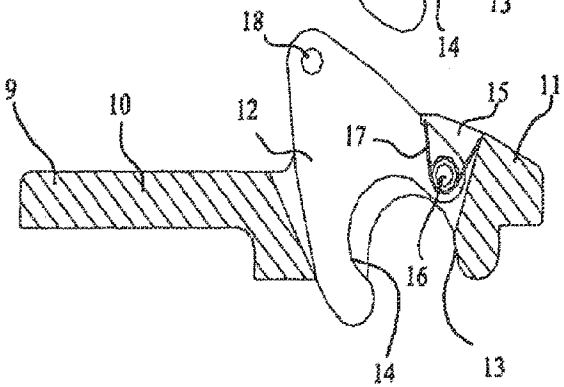
FIG. 7 shows a cross sectional view of an embodiment of a coupler suited for use in the connection of modular panel elements.
Figure 8B:
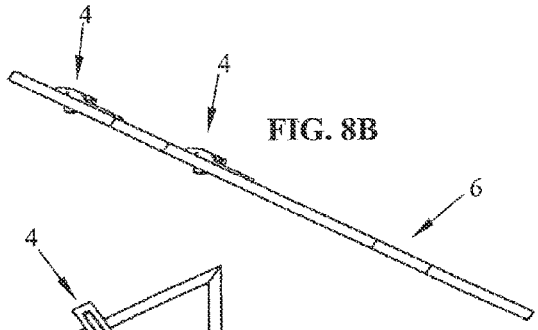
FIG. 8B shows a triangular panel element in a side view.
Figure 8A:
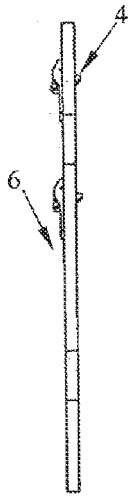
FIG. 8A shows a triangular panel element in a side view.
Figure 8D:
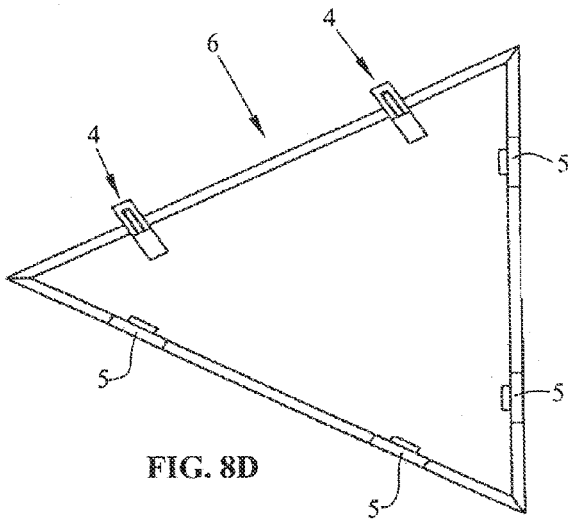
FIG. 8D shows a triangular panel element in a top view.
Figure 8C:
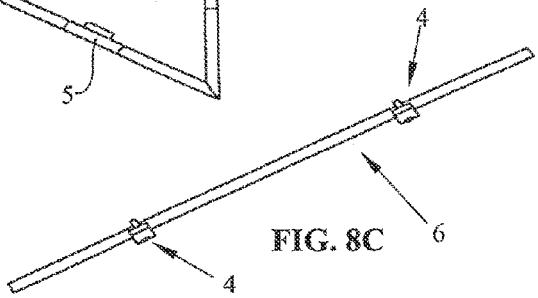
FIG. 8C shows a triangular panel element in a side view.

In FIGS. 5-7 is shown a preferred coupler arrangement suited for use in a protective shelter assembly according to the invention. The coupler 4 comprises a coupler body part 9 having an extended part 10 for mounting the coupler on the planar part 2 of the modular shelter panel and a coupler pawl 11 with a coupler claw 12 adapted therein. The coupler pawl 111 forms a pawl recess 13 having a cross-sectional shape of a concave arc. The coupler claw 12 is shaped to form a complementary concave claw recess 14. The coupler pawl 111 has a slot 15, wherein the coupler claw 12 is inserted and pivotally secured to the coupler pawl by means of a pivot pin 16 fixed to one of the pawl arcuate portions on both sides of the claw with the arcuate recess 14. About the pivot pin 16 is adapted a coiled spring having its one end secured in the coupler pawl 11 and the other end on the coupler claw 12. The coiled spring serves to close the coupler claw 12 toward the center of the coupler pawl recess 13. The coupler claw 12 has also an eye ring 18 for threading a release rope therethrough.

The connection of the modular protective panels into a shelter construction takes place as follows. Two protective panels are aligned adjacent to each other so that the adjacent panels have one coupler-type edge and one slotted edge abutting. Thereupon, pulling the release rope of the coupler members 4 allows the coupler claw 12 to rotate about its pivot pin 16 as shown in FIG. 7 whereby, having the panels aligned in a desired angular position relative to each other, the coupler 4 can be inserted into the respective open slot 5 of the adjacent panel. When the rope is next released, the coupler claw 12 rotates under the torque applied by a spring 17 into the position shown in FIG. 6, whereby the coupler 4 clamps the panels together by locking itself into the open slot 5. The couplers 4 may be either closed from the interior side of the panels in the shelter being erected, whereby the coupler body part 9 receives stresses imposed on the exterior side of the shelter or, alternatively, the couplers are closed from the exterior side of the shelter, whereby the erection of the shelter is easier. In the latter case, the self-tightening action of the coupler pawl securingly takes the loads imposed on the coupler mechanism.

In FIGS. 8 and 9 is shown the location of coupler members and open slots for two modular shelter panels having the most preferred shapes. The modular panel of FIG. 8 has the shape of a equilateral triangle, while the modular panel of FIG. 9 has the shape of a square with a side length equal to that of the triangular panel. Modular panels shaped in this fashion can be connected to each other in all kinds of assembly and position.

Figure 10:
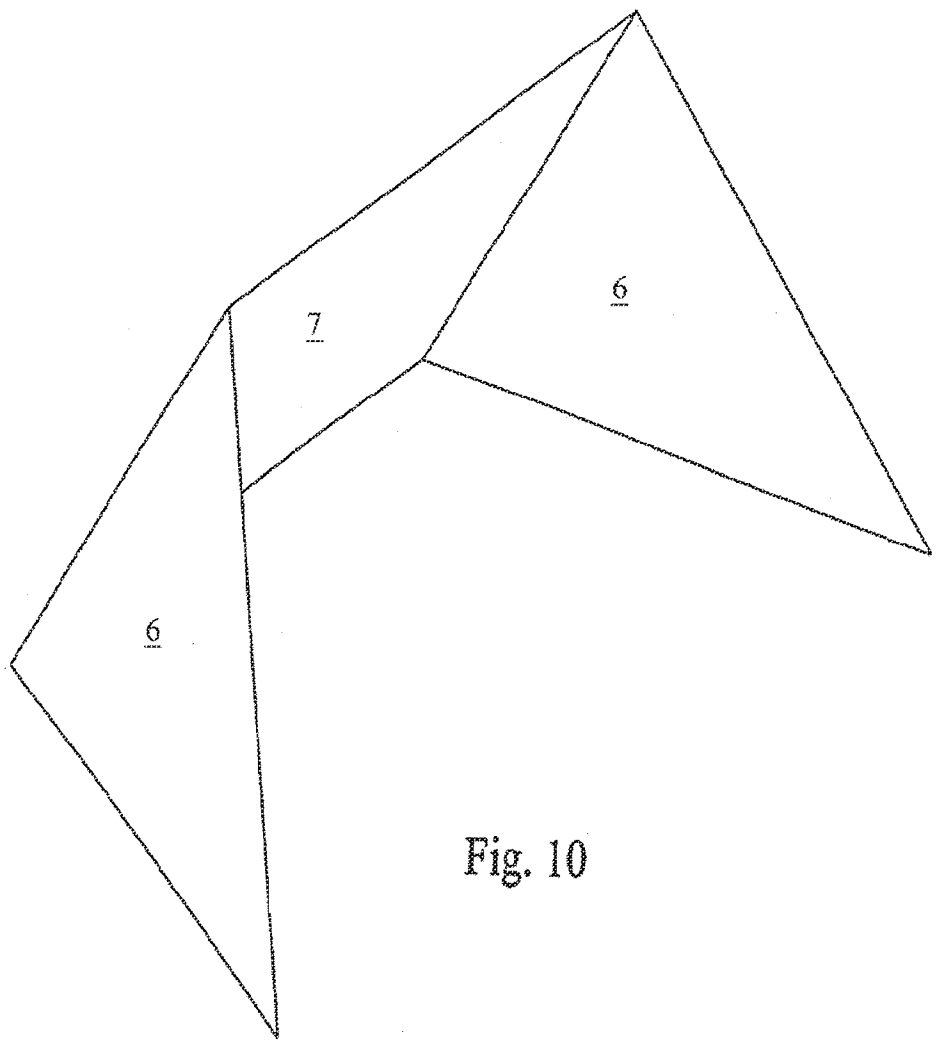
FIG. 10 shows an application of the invention where the coupler means have been removed for clarity of view.
Figure 11:
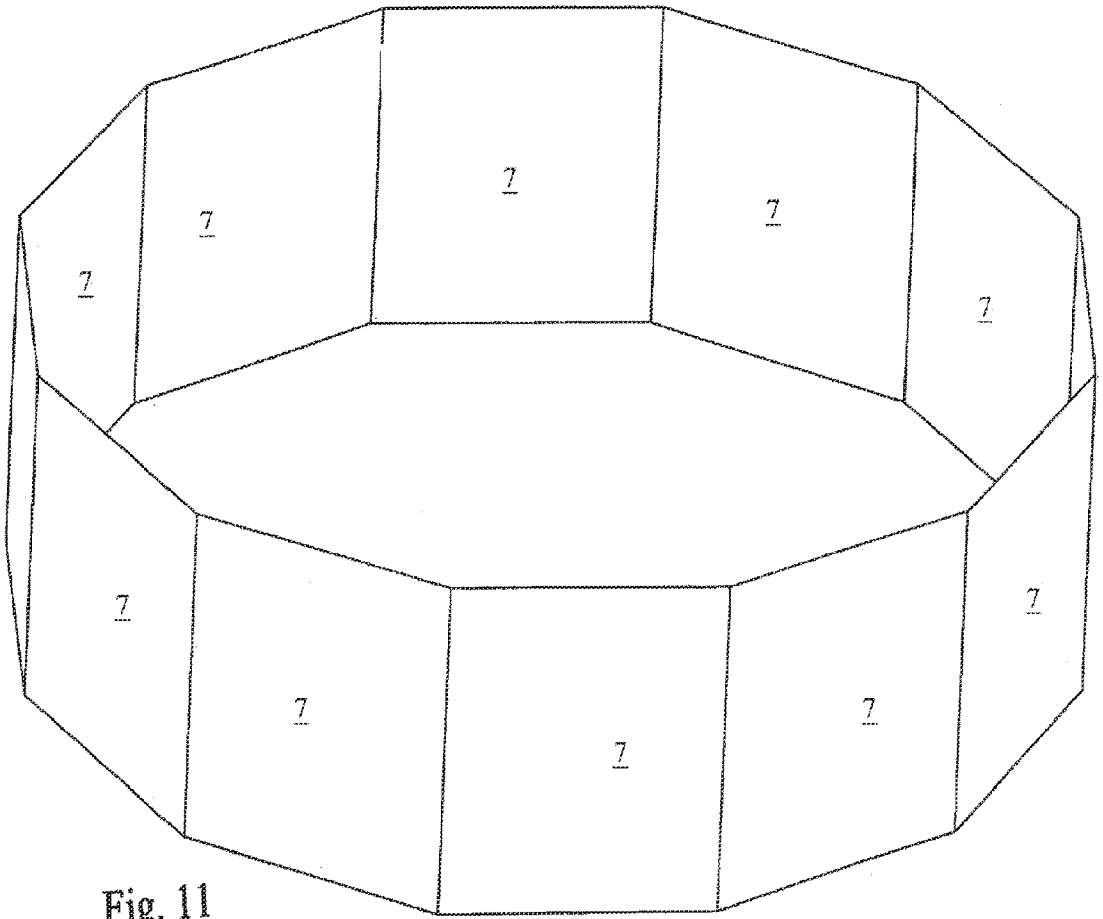
FIG. 11 shows an application of the invention where the coupler means have been removed for clarity of view.
Figure 12:
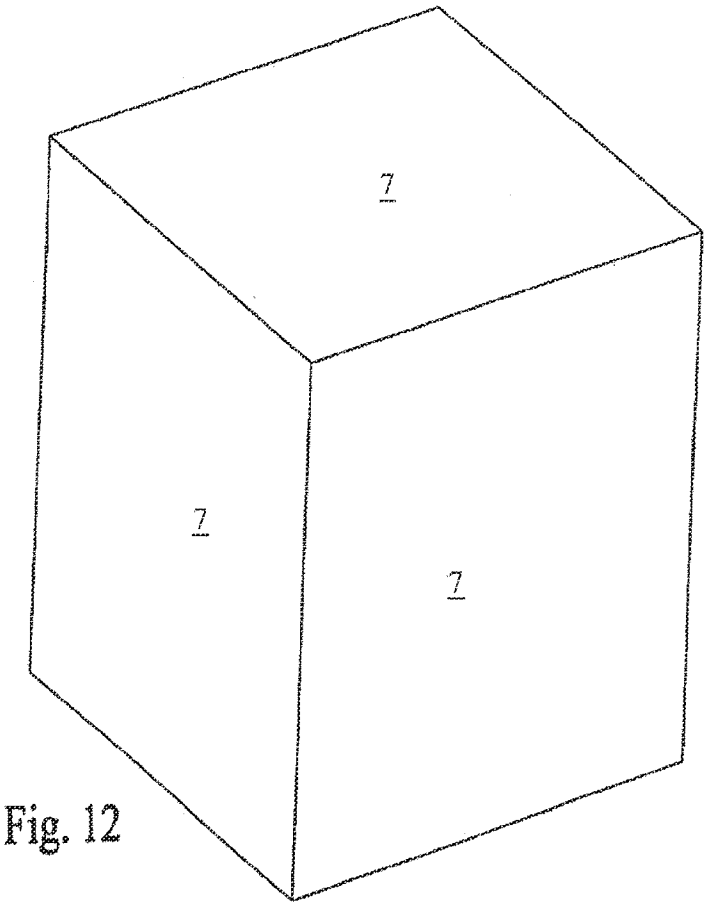
FIG. 12 shows an application of the invention where the coupler means have been removed for clarity of view.
Figure 13:
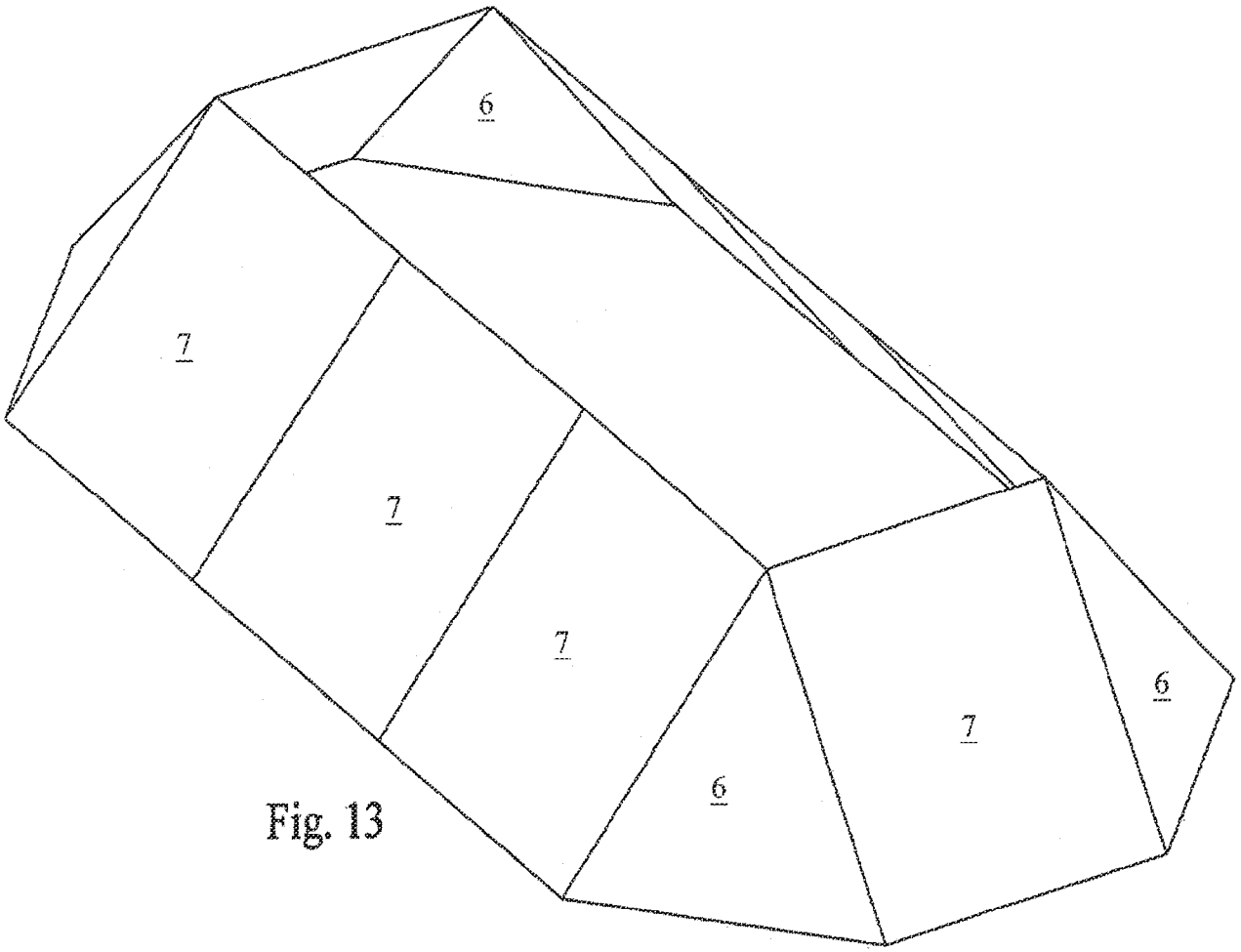
FIG. 13 shows an application of the invention where the coupler means have been removed for clarity of view.
Figure 14:
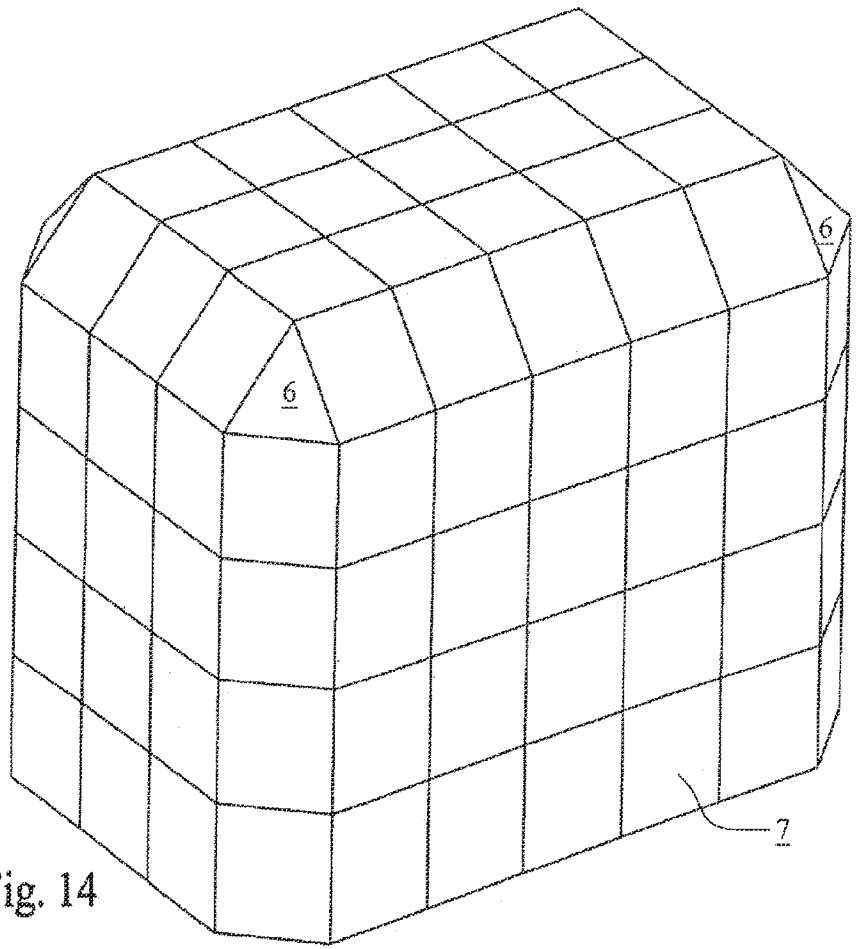
FIG. 14 shows an application of the invention where the coupler means have been removed for clarity of view.
Figure 15:
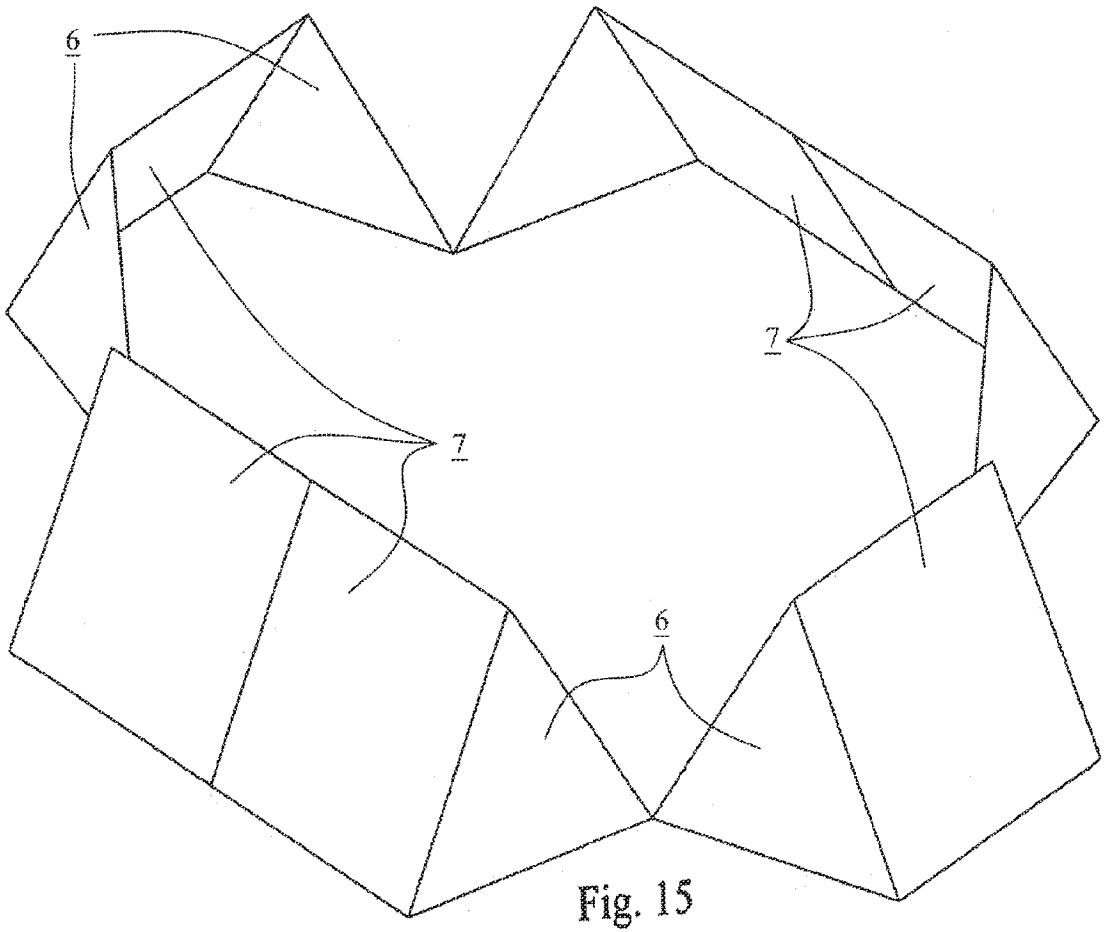
FIG. 15 shows an application of the invention where the coupler means have been removed for clarity of view.

In FIGS. 10-15 is shown a selection of shelter constructions erectable according to the invention. The construction shown in FIG. 10 is suited for use as a quick-erect shelter of a single soldier or combat pair. The shelter comprises two modular triangular panels supporting a square panel. The shelter structure is sturdy and stays well in shape. The construction of FIG. 11 may be employed as a protective shelter for tents, supplies or armament. The shelter is comprised of modular panels of square or rectangular shape. As shown in FIG. 12, a simple closed shelter can be erected as a cubicle comprised of square panels. Respectively, FIG. 13 illustrates the ease of use of triangular panels in the construction of surfaces at slanted angles. While a slanted surface cannot be erected using a square panel, a triangular panel allows the angle of a given panel to be set as desired in both the horizontal and vertical directions. Using a number of triangular modular panels, even more complicated shelter structures are feasible. In FIG. 14 is illustrated a relatively large closed shelter. As is evident also from this diagram, triangular modular panels make the erection of an angled shelter structure simple and easy. As shown in FIG. 15, the constructions illustrated in FIG. 10 can be combined into a structure giving protection in four directions.

Figure 16:
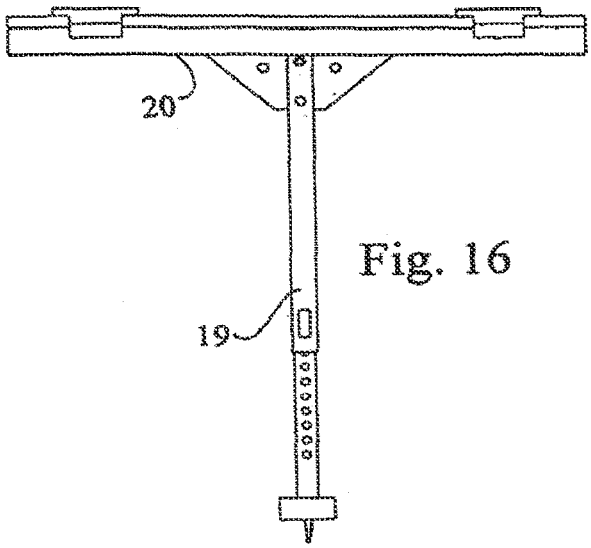
FIG. 16 shows a support leg suited for use in conjunction with the invention.
Figure 17:
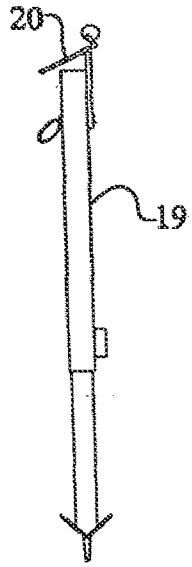
FIG. 17 shows a support leg suited for use in conjunction with the invention.
Figure 18:
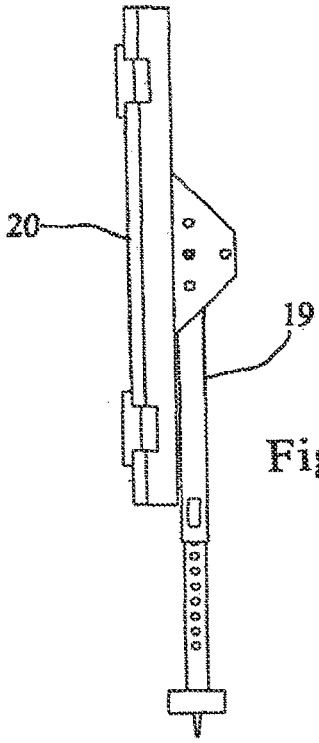
FIG. 18 shows a support leg suited for use in conjunction with the invention.

In certain constructions, e.g., those having large roof areas, support columns can be used to prevent sagging of the roof. The support column may be such as shown in FIGS. 16-18. This support column construction comprises a simple telescopic column part 19 with a fixture part 20 rotatably connected to the column part. Being freely rotatable about the column part end, the support column may also be used as an oblique brace or support to the sidewalls.

As is evident from the diagrams discussed above, the invention makes it possible to implement a plurality of different protective shelter structures.

In addition to those described above, the invention may have alternative embodiments.

The profile of the planar part edges can be varied and the edge may be fabricated from continuous metal sections, for instance. However, the panel structure is hereby complicated unnecessarily and, moreover, the weight and cost of the modular panel element become higher. While the sets of triangular and square modular panels may be complemented with panels of other shape, particularly having the shape of a rectangle or non-equilateral triangle, the unlimited connectability of different modular panels is hereby constrained. The connection technique and coupler means of the modular panels can be replaced by, e.g., the clamping means used in transport pallets, but also herein the clamping surface and the compatible slot are most advantageously designed to have an arcuate cross-sectional shape so as to permit any angular alignment between modular panels adjacently connected to each other. Advantageously, the edges of the modular panels are longitudinally straight. The connection system comprising two coupler members/slots on one edge of the panel may alternatively comprise a greater number of coupler means and open slots compatible therewith. Obviously, the number of coupler means must at all times be selected to take the stresses occurring in service.

What is claimed is:

1. A ballistic shelter system capable of forming a protective shelter from at least two mutually connectable modular panel elements, said system comprising:

a plurality of modular panel elements, each said panel element having a generally planar portion made of a composite material capable of protecting and resisting fragments from explosives and bullets from firearms, each said panel element having a plurality of straight edges which are equal in length, each said edge having a pair of spaced apart coupler portions, wherein:

said plurality of modular panel elements includes at least one equilateral triangular element and at least one square element;

at least one of said pair of coupler portions of each of said panel elements includes a pair of cylindrical portions of said edge, each of said cylindrical portions of said edge and a corresponding panel portion defining a corresponding slot; and at least one of said pair of coupler portions of each of said panel elements includes a pair of coupler claws pivotally mounted on said panel portion, each of said coupler claws has a concave claw recess configured to extend around said cylindrical portion and into said corresponding slot when one of said edges having a pair of cylindrical portions abuts another one of said edges having a pair of coupler claws thereby allowing connection of abutting panel elements in a plurality of angular orientations, wherein each of said coupler claws includes a spring attached to the corresponding panel portion and adapted to close said coupler claw around an abutting one of said cylindrical portions.

2. The shelter system of claim 1 wherein each of said coupler claws has a rope receiving portion adapted to receive a rope to allow pulling of the rope to open said coupler claw.

3. The shelter system of claim 1 wherein said composite material of said panel elements includes a glass-fiber-reinforced composite material.

4. The shelter system of claim 1 wherein said edges are fabricated from the composite material.

5. The shelter system of claim 1 wherein said edges have a rounded profile.

6. The shelter system of claim 4 wherein said composite material of said panel elements includes a glass-fiber-reinforced composite material with an aramid fiber.

7. The shelter system of claim 1 wherein said coupler claws are pivotally connected to said panel portions.

8. The shelter system of claim 7 wherein said conclave claw recess is configured and arranged to retain one of said cylindrical portions in a first position, and to allow removal of one of said cylindrical portions in a second position.

* * * * *